US010093096B2

(12) United States Patent
White et al.

(10) Patent No.: US 10,093,096 B2
(45) Date of Patent: Oct. 9, 2018

(54) MAINTENANCE OF A PRINTHEAD OF A PRINTER

(71) Applicant: HEWLETT-PACKARD DEVELOPMENT COMPANY, L.P., Houston, TX (US)

(72) Inventors: Lawrence H White, Corvallis, OR (US); Ronald A Askeland, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/329,972

(22) PCT Filed: Jul. 31, 2014

(86) PCT No.: PCT/US2014/049121
§ 371 (c)(1),
(2) Date: Jan. 27, 2017

(87) PCT Pub. No.: WO2016/018359
PCT Pub. Date: Feb. 4, 2016

(65) Prior Publication Data

US 2017/0259569 A1 Sep. 14, 2017

(51) Int. Cl.
*B41J 2/14* (2006.01)
*B41J 2/17* (2006.01)

(52) U.S. Cl.
CPC ..... *B41J 2/1433* (2013.01)

(58) Field of Classification Search
CPC ..... B41J 2/14129; B41J 2/14145; B41J 2002/14475; B41J 2/1433
See application file for complete search history.

(56) References Cited

U.S. PATENT DOCUMENTS 5,777,636 A * 7/1998 Naganuma ..... B41J 2/04581 347/10
6,033,049 A * 3/2000 Fukuda ..... B41J 2/211 347/100

(Continued)

FOREIGN PATENT DOCUMENTS

JP 64-0427956 1/1989
JP 2000127435 5/2000

(Continued)

OTHER PUBLICATIONS

Li, E. Q. et al., Abstract of "Design and fabrication of a PET/PTFE-based piezoelectric squeeze mode drop-on-demand inkjet printhead interchangeable nozzle", Elsevier B.V., Sep. 2010.

*Primary Examiner* — Patrick King
(74) *Attorney, Agent, or Firm* — HP Inc. Patent Department

(57) ABSTRACT

A printhead of a printer includes a nozzle plate having a first layer, a second layer, and an intermediate channel. The first layer can have at least one fluid chamber for holding an immiscible fluid, and a plurality of ejection fluid chamber for holding an ejection fluid. The second layer can have a plurality of ejection fluid nozzles, one ejection fluid nozzle being in fluid communication with one ejection fluid chamber. The intermediate channel can form a passage between the first layer and the second layer. Further, the intermediate channel is in fluid communication with the fluid chambers to carry the immiscible fluid from the fluid chambers towards each of the ejection fluid nozzles for forming a layer of the immiscible fluid over the ejection fluid chambers to maintain the printhead.

20 Claims, 8 Drawing Sheets

(56) References Cited

U.S. PATENT DOCUMENTS

| | | | | |
|---|---|---|---|---|
| 6,158,842 | A * | 12/2000 | Ando | B41J 2/14274 347/45 |
| 6,561,608 | B1 * | 5/2003 | Yamamoto | B05C 5/0254 347/15 |
| 6,938,986 | B2 | 9/2005 | Murakami et al. | |
| 7,347,531 | B2 | 3/2008 | Kachi | |
| 2002/0109744 | A1 * | 8/2002 | Shindo | B41J 2/1433 347/23 |
| 2002/0171705 | A1 | 11/2002 | Rhoads et al. | |
| 2003/0184616 | A1 * | 10/2003 | Yang | B41J 2/1433 347/47 |
| 2005/0161844 | A1 | 7/2005 | Dunfield et al. | |
| 2009/0225134 | A1 | 9/2009 | Tsukada | |
| 2011/0310181 | A1 | 12/2011 | Curcio et al. | |
| 2013/0033545 | A1 * | 2/2013 | Nakahashi | B41J 2/1433 347/45 |
| 2013/0162718 | A1 * | 6/2013 | Noda | B41J 2/1433 347/47 |
| 2013/0284956 | A1 | 10/2013 | Kwon | |

FOREIGN PATENT DOCUMENTS

| | | |
|---|---|---|
| JP | 2001158107 | 6/2001 |
| JP | 2009298024 | 12/2009 |

* cited by examiner

MAINTENANCE OF A PRINTHEAD OF A PRINTER

BACKGROUND

Printers, such as inkjet printers, find a variety of applications owing to low cost, high speed, and high quality of printing. An inkjet printer includes a printhead having a plurality of nozzles for precisely delivering small volumes of ink or other ejection fluid on to a substrate for printing on the substrate by a non-impact process. The ejection fluid employed in such printers is usually water-based. Accordingly, in such printers, measures are usually taken to prevent the ejection fluid from drying up.

BRIEF DESCRIPTION OF FIGURES

The detailed description is provided with reference to the accompanying figures. In the figures, the left-most digit(s) of a reference number identifies the figure in which the reference number first appears. The same numbers are used throughout the figures to reference like features and components.

DETAILED DESCRIPTION

Figure 1:
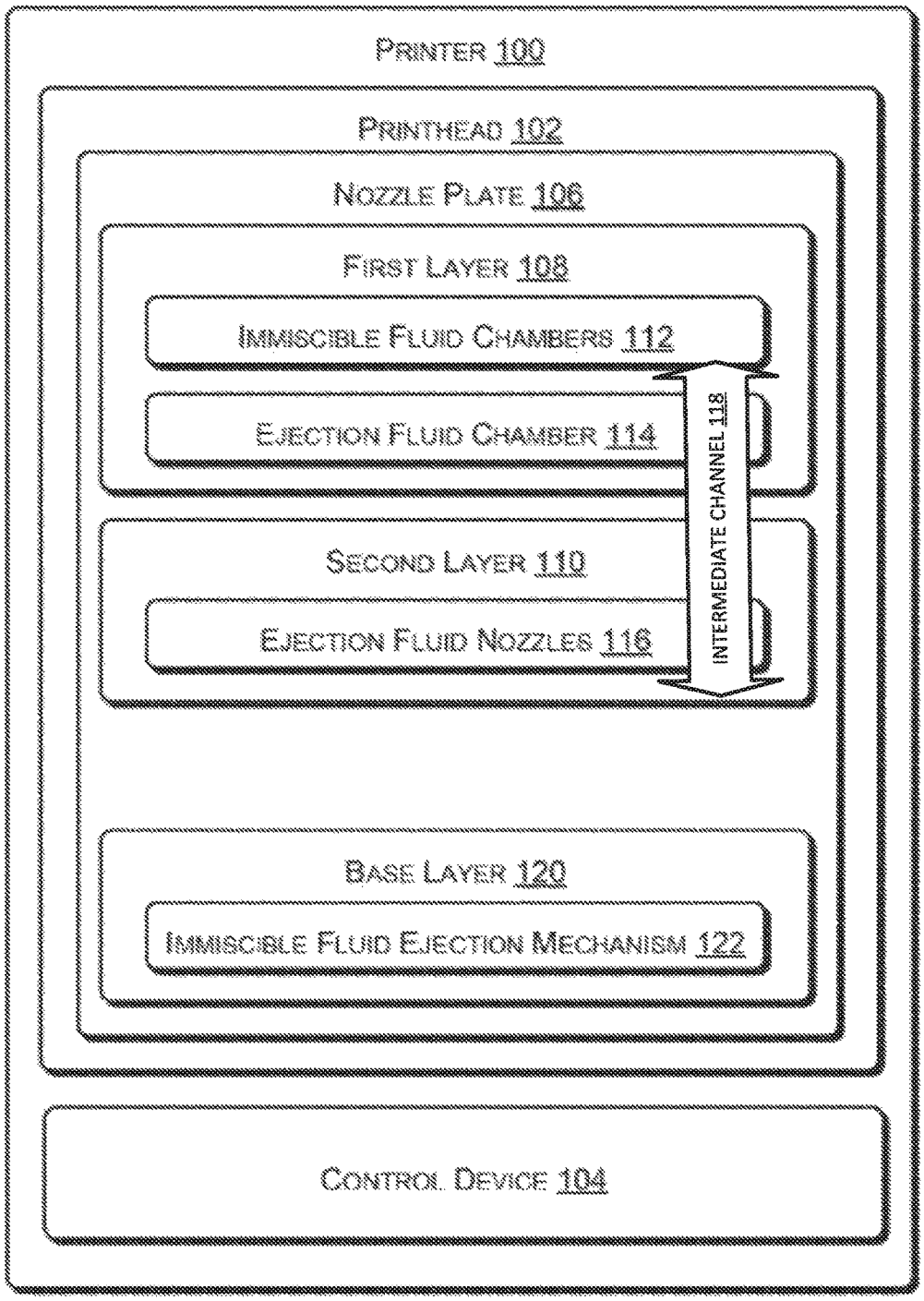
FIG. 1 illustrates a schematic of a printer, according to an example of the present subject matter.

Generally, all ejection fluid nozzles of a printhead of a printer may not function continuously, depending on type of print, colors to be used, and the area of the substrate on which the printing is to be achieved. In such a case, an ejection fluid, such as a water-based ink or a substrate pre-treatment fluid, in non-functioning ejection fluid nozzles may lose water and may form a viscous mix of non-aqueous components of the ejection fluid. The drying of the ejection fluid may block the ejection fluid nozzles which, when used for printing, may eject the viscous mix onto the substrate, adversely affecting quality of prints. Accordingly, regular maintenance of the printhead is done in order to prevent the ejection fluid nozzles from being blocked due to drying of the ejection fluid. Generally, for maintaining the printhead, a servicing assembly is usually provided on the printer. The servicing assembly usually has a collecting tray movable with respect to the printhead. All or at least the non-functioning ejection fluid nozzles of the printhead are controlled to eject the ejection fluid into the collecting tray to prevent drying of the ejection fluid and accumulation of the dried components in the ejection fluid nozzle. However, providing a separate servicing assembly on the printer may affect an overall cost of the printer.

The present subject matter provides an approach for maintaining a printhead of a printer without having to employ a separate servicing assembly in the printer. The maintenance of the printhead, according to the present subject matter, involves forming an ejection fluid-impermeable layer of a low-volatility, immiscible fluid, referred to as immiscible fluid, in a plurality of ejection fluid nozzles in the printhead. The ejection fluid-impermeable layer can reduce evaporation of volatile components from an ejection fluid in the printhead. The ejection fluid can include ink for printing on a substrate, a pre-treatment fluid for pre-treating the substrate before printing, a coating fluid for the substrate, or any other fluid which can be applied on the substrate. Further, the low-volatility of the immiscible fluid can refer to the volatility of the immiscible fluid being substantially lower than a volatility of the ejection fluid. The formation of such a layer prevents the ejection fluid from losing water content, thereby, preventing clogging of the ejection fluid nozzles.

In an example, the printhead of the printer includes a nozzle plate having a plurality of layers. The nozzle plate can include a first layer, a second layer, and an intermediate channel forming a passage between the first layer and the second layer. The first layer can have at least one immiscible fluid chamber for holding the immiscible fluid and a plurality of ejection fluid chambers for holding the ejection fluid. The ejection fluid chambers can be isolated from the immiscible fluid chamber. Further, the second layer can have the plurality of ejection fluid nozzles formed therein. In an example, an ejection fluid chamber in the first layer can be in direct fluid communication with an ejection fluid nozzle.

Further, according to an aspect of the present subject matter, the immiscible fluid chamber in the first layer and the ejection fluid nozzles can be in fluid communication through the intermediate channel. Accordingly, the intermediate channel can carry the immiscible fluid from the immiscible fluid chamber to the ejection fluid nozzles for forming a layer of the immiscible fluid over the ejection fluid chambers to prevent the drying of the ejection fluid and, therefore, to maintain the printhead. In one case, the immiscible fluid can form a layer over a surface of the ejection fluid in the ejection fluid chambers on a side which is exposed to the outside. For instance, the immiscible fluid can form the layer in the ejection fluid nozzles.

In an example, the printhead can further include a base layer coupled to the first layer and the base layer can be provided as having an immiscible fluid ejection mechanism to achieve ejection of the immiscible fluid from the immiscible fluid chamber into the intermediate channel and, subsequently, to form the layer over the ejection fluid chambers. In an example, during operation of the immiscible fluid ejection mechanism, an ejection fluid ejection mechanism can be stopped from ejecting the ejection fluid from the ejection fluid nozzles. Further, the immiscible fluid ejection mechanism can be operated to eject the immiscible fluid from the immiscible fluid chamber in the printhead to the ejection fluid nozzles.

In one example, the intermediate channel can be formed as being sandwiched between the first layer and the second layer. In such a case, the second layer can include at least one immiscible fluid nozzle which is in fluid communication with the immiscible fluid chamber through the intermediate channel. The immiscible fluid nozzle can be in further fluid communication with the ejection fluid nozzles. Therefore, the immiscible fluid can flow from the immiscible fluid chamber, into the immiscible fluid nozzle through the intermediate channel, and into the ejection fluid nozzles to form the layer over the ejection fluid chambers. In one example, the immiscible fluid nozzle can be offset from the immiscible fluid ejection mechanism. Further, in another case, a size of the immiscible fluid nozzle can be substantially greater than a size of the ejection fluid nozzles.

In another example, in order to prevent the ejection of the immiscible fluid from the printhead, the intermediate channel can be laterally formed with respect to the first layer and the second layer. In such a case, when the immiscible fluid ejection mechanism is operated to eject the immiscible fluid, the immiscible fluid flows from the immiscible fluid chamber into the intermediate channel and into the ejection fluid nozzles in the second layer forming the film in the ejection fluid nozzles, over ejection fluid in the ejection fluid chambers. In another example, the film of the immiscible fluid can be formed in the intermediate channel.

Since the present subject matter provides for the use of the low-volatility, immiscible fluid to form a layer over the ejection fluid to prevent the drying of the ejection fluid, the printer has negligible downtime and, therefore, high production. Additionally, the immiscible fluid chamber and the immiscible fluid ejection mechanism are in-built within the printhead and no peripheral apparatus is used for keeping the printhead and the ejection fluid nozzles in service. As a result, the overall cost of the printer is substantially less.

The above aspects of the present subject matter are further described in the figures and associated description below. It should be noted that the description and figures merely illustrate the principles of the present subject matter. Therefore, various arrangements that use the principles of the present subject matter, although not explicitly described or shown herein, can be devised from the description and are included within its scope.

FIG. 1 illustrates components of a printer 100, according to an example of the present subject matter. The printer 100 may include a printhead 102 and a control device 104 for regulating maintenance of the printhead 102. According to an aspect, the printhead 102 can include a nozzle plate 106 having a first layer 108 and a second layer 110. The first layer 108 can have at least one immiscible fluid chamber 112 for holding a low-volatility, immiscible fluid and can have a plurality of ejection fluid chambers 114 for holding an ejection fluid. The ejection fluid can include ink for printing on a substrate, a pre-treatment fluid for pre-treating the substrate before printing, a coating fluid for the substrate, or any other fluid which can be applied on the substrate. The immiscible fluid chamber 112 can be isolated from the ejection fluid chambers 114. In an example, the ejection fluid chambers 114 can be isolated from each other. For instance, in case of a color printer, the ejection fluid chambers 114 ejecting the ink of a certain color can be isolated from the ejection fluid chambers 114 ejecting the ink of another color. The second layer 110 can have a plurality of ejection fluid nozzles 116 formed therein and in fluid communication with the ejection fluid chambers 114. In an example, one ejection fluid nozzle 116 can be in fluid communication with one ejection fluid chamber 114.

In one example, the printhead 102 is provided with measures for achieving maintenance of the printhead 102. Accordingly, the printhead 102 can include an intermediate channel 118 which forms a passage between the first layer 108 and the second layer 110. The intermediate channel 118 can carry the low-volatility, immiscible fluid to the plurality of ejection fluid nozzles 116 to form an ejection fluid-impermeable layer over the ejection fluid to prevent drying of the ejection fluid. The ejection fluid-impermeable layer can reduce evaporation of volatile components from the ejection fluid in the printhead 102.

For instance, the low-volatility, immiscible fluid, referred to as the immiscible fluid, can be any oil, such as a vegetable oil or a mineral oil. In one example, the immiscible fluid can include oils of aliphatic hydrocarbons having a long chained-structure or a branched-structure. In another example, the immiscible fluid can include Fluorinert™ materials or perfluorinated materials. In yet another example, the immiscible fluid can be paraffin liquid or an isoparaffin liquid, such as Isopar™. Further, in one case, the immiscible fluid can be a fluid being 1 part soluble in 200 parts per million (ppm) of water at 20° Celsius. According to an aspect, the immiscible fluid is selected based on the molecular weight of the immiscible fluid. In an example, the immiscible fluid is so selected that it does not evaporate and, at the same time, allows the ejection fluid to pass through for ejection of the ejection fluid. Accordingly, the low-volatility of the immiscible fluid can refer to the volatility of the immiscible fluid being substantially lower than a volatility of the ejection fluid.

In an example, the intermediate channel 118 can be in fluid communication with the immiscible fluid chamber 112 and the ejection fluid chambers 114. Accordingly, the intermediate channel 118 can carry the immiscible fluid from the immiscible fluid chamber 112 towards the ejection fluid nozzles 116 and, therefore, towards the ejection fluid chambers 114. Further, the immiscible fluid can form the ejection fluid-impermeable film of the immiscible fluid over the ejection fluid retained in the ejection fluid chambers 114 to maintain the printhead 102, i.e., to prevent the drying of the ejection fluid in the printhead 102. The structure of the intermediate channel 118 is explained in further detail with reference to FIG. 3 and FIG. 4.

The nozzle plate 106 can further include a base layer 120, also referred to as a primer layer. In an example, the base layer 120 can form a support surface for the first layer 108. In other words, the first layer 108 is coupled to and formed on the base layer 120. In addition, the base layer 120 can include an immiscible fluid ejection mechanism 122 for ejecting the immiscible fluid.

The control device 104 can regulate the immiscible fluid ejection mechanism 122 to control the supply of the immiscible fluid towards the plurality of ejection fluid nozzles 116 for maintaining the printhead 102. For example, the control device 104 can cease ejection of the ejection fluid from the ejection fluid nozzles 116 and regulate ejection of the immiscible fluid into the intermediate channel 118 or into the ejection fluid nozzles 116, or both, for forming the layer of the immiscible fluid over the ejection fluid. The operation of the control device 104 is explained in detail later with reference to FIG. 5.

Figure 2A:
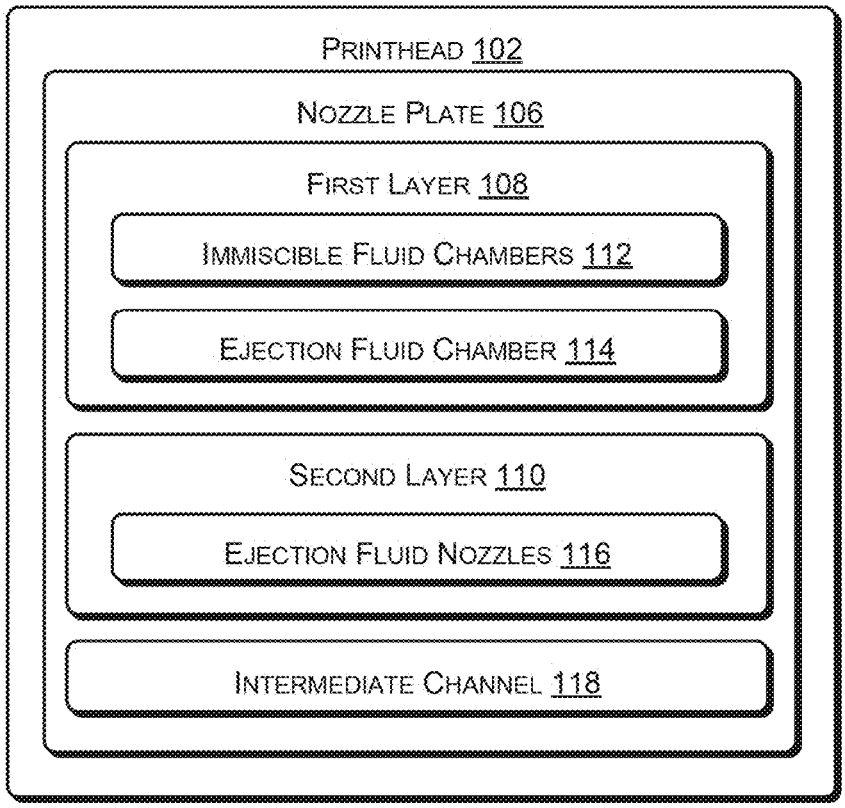
FIG. 2A illustrates a schematic of a printhead of the printer, according to an example of the present subject matter.

FIG. 2A illustrates a schematic of the printhead 102 of the printer 100, according to an example of the present subject matter. As described above with reference to FIG. 1, the printhead 102 includes the nozzle plate 106 having the first layer 108, the second layer 110, and the intermediate channel 118 forming the passage for the immiscible fluid from the first layer 108 to the second layer 110. The components of the printhead 102 are explained in further detail with reference to FIG. 2B.

Figure 2B:
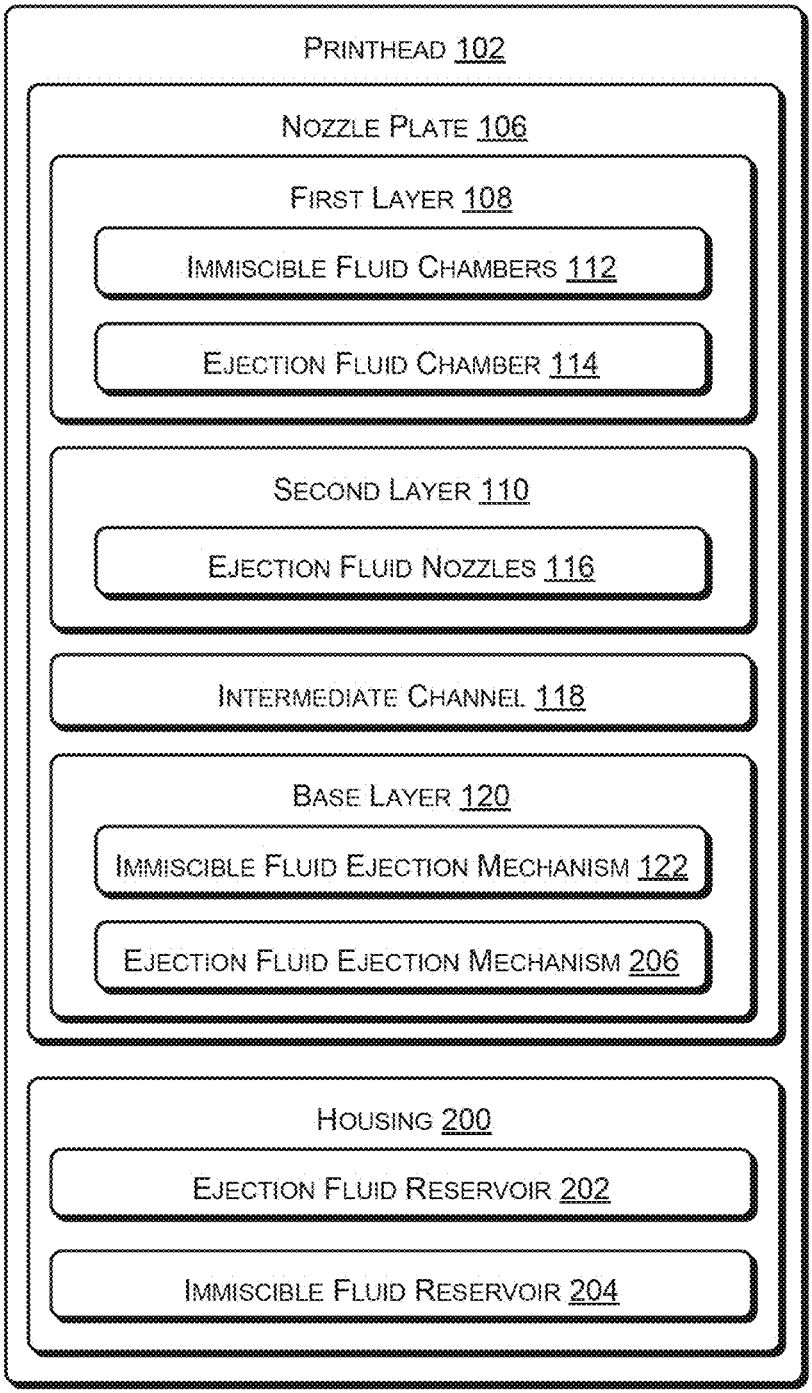
FIG. 2B illustrates a detailed schematic of the printhead, according to an example of the present subject matter.

FIG. 2B illustrates a schematic showing various components of the printhead 102, in accordance with an example of the present subject matter. As mentioned previously, the printhead 102 can include the nozzle plate 106 having provided with measures for maintaining the printhead 102, i.e., for preventing the drying of the ejection fluid in the printhead 102. The printhead 102 can further include a housing 200 which can house the nozzle plate 106. In an example, the housing 200 can be formed of a metal to provide rigidity to the printhead 102 and also for mounting the printhead 102 on a carriage (not shown) of the printer 100.

For instance, the printhead 102 can be a scanning-type printhead or a fixed-type printhead, such as a page-wide array (PWA) printhead. In the former case, i.e., when the printhead 102 is the scanning-type, the carriage can be a movable part of the printer 100 and can move the printhead 102 with reference to the substrate on which the printing is to be achieved. In the latter case, the carriage can be a fixed member and can remain fixed with reference to the substrate while the substrate moves with respect to the printhead 102 and the ejection fluid nozzles 116 eject the ejection fluid from the ejection fluid chambers 114 for printing on the substrate. Further, the housing 200 can be have an ejection fluid reservoir 202 in fluid communication with the ejection fluid chambers 114 to supply the ejection fluid to the ejection fluid chambers 114 for printing. In addition, the housing 200 can have an immiscible fluid reservoir 204 for storing the immiscible fluid and supplying the immiscible fluid to the immiscible fluid chamber 112 for achieving maintenance of the printhead 102.

The base layer 120 of the nozzle plate 106, as mentioned previously, forms the support surface for the first layer 108 and includes the immiscible fluid ejection mechanism 122 for ejecting the immiscible fluid towards the ejection fluid nozzles 116. In addition, the base layer 120 includes an ejection fluid ejection mechanism 206 for ejecting the ejection fluid from the ejection fluid nozzles 116 onto the substrate for printing on the substrate. As explained for the immiscible fluid ejection mechanism 122, the control device 104 regulates the ejection fluid ejection mechanism 206 to achieve the printing on the substrate. In an example, the immiscible fluid ejection mechanism 122 or the ejection fluid ejection mechanism 206, or both can be formed as an integrated circuitry in the base layer 120. For instance, the immiscible fluid ejection mechanism 122 and the ejection fluid ejection mechanism 206 can be formed as etched metallic conductors in the base layer 120.

Further, the immiscible fluid ejection mechanism 122 in the base layer 120 can be formed to be in the vicinity of the immiscible fluid chamber 112. In an example, the immiscible fluid chamber 112 can be provided with a separate immiscible fluid ejection mechanism 122. In another example, a single immiscible fluid ejection mechanism 122 may serve for ejecting the immiscible fluid from the immiscible fluid chamber 112. Similarly, in one case, the ejection fluid ejection mechanism 206 can be formed in the vicinity of the ejection fluid chambers 114 for ejecting the ejection fluid from the ejection fluid chambers 114, into the ejection fluid nozzles 116, and onto the substrate for printing on the substrate.

In an example, the immiscible fluid ejection mechanism 122 can be a piezoelectric element or a thermal element, such as a thermal resistor. Further, in an example, the ejection fluid ejection mechanism 206 can be a piezoelectric element or thermal element. The immiscible fluid ejection mechanism 122 and the ejection fluid ejection mechanism 206 can be coupled to the control device 104 of the printer 100 for the control device 104 to regulate the operation of the immiscible fluid ejection mechanism 122 and the ejection fluid ejection mechanism 206. As mentioned above, the operation of the control device 104 for regulating the immiscible fluid ejection mechanism 122 and the ejection fluid ejection mechanism 206 is explained in detail later with reference to FIG. 5.

During operation, the immiscible fluid ejection mechanism 122 causes release of the immiscible fluid from the immiscible fluid chamber 112 to the ejection fluid nozzles 116 to form the ejection fluid-impermeable film or layer of the immiscible fluid over the ejection fluid in the ejection fluid chambers 114. In an example, the ejection fluid-impermeable layer can be formed in the ejection fluid nozzles 116 or in the intermediate channel 118, or both, to form the film over the ejection fluid in the ejection fluid chambers 114. For instance, the ejection fluid-impermeable layer can be formed over a surface of the ejection fluid which may be exposed to the atmosphere. In another example, the ejection fluid-impermeable layer can be formed in the intermediate channel 118 and serve the same purpose of protecting the ejection fluid from drying.

Further, during printing operation of the printhead 102, the ejection fluid can be expelled from the ejection fluid nozzles 116 through the ejection fluid-impermeable layer and a miniscule quantity of the immiscible fluid may be entrained along with the ejection fluid. However, the immiscible fluid being immiscible with the ejection fluid, the ejection fluid is unable to entrain large quantities of the immiscible fluid along. Accordingly, quality of prints is unaffected by such small amounts of the immiscible fluid being present along with the ejection fluid during printing.

With reference to the intermediate channel 118, in an example, the intermediate channel 118 can be formed between the first layer 108 and the second layer 110, for instance, sandwiched between the first layer 108 and the second layer 110 to form the passage between the two layers 108 and 110. Accordingly, the intermediate channel 118 can serve as a passage for the immiscible fluid from the immiscible fluid chamber 112 to the ejection fluid nozzles 116 upon activation of the immiscible fluid ejection mechanism 122. In said example, the second layer 110 can include at least one immiscible fluid nozzle (not shown) in fluid communication with the immiscible fluid chamber 112 through the intermediate channel 118. The immiscible fluid nozzle can be in further fluid communication with the ejection fluid nozzles 116.

Accordingly, when the immiscible fluid ejection mechanism 122 is activated, the immiscible fluid can flow from the immiscible fluid chamber 112 into the intermediate channel 118, into the immiscible fluid nozzle, and finally, into the ejection fluid nozzles 116 to form the ejection fluid-impermeable layer over the ejection fluid in the ejection fluid chambers 114. The intermediate channel 118 enhances a distance traversed by the immiscible fluid to flow from the immiscible fluid chamber 112 to the immiscible fluid nozzle. Accordingly, with the increase in the distance flown, a drag experienced by the immiscible fluid is substantially large, as a result of which the immiscible fluid may lose substantial velocity and can be prevented from being ejected from the immiscible fluid nozzle.

In another example, the intermediate channel 118 can be laterally formed with respect to the first layer 108 and the second layer 110, for instance, as a part of features for preventing ejection of the immiscible fluid. In other words, the intermediate channel 118 can extend laterally from the first layer 108 and connect to the second layer 110. In such a case, the immiscible fluid flows from the immiscible fluid chamber 112 into the intermediate channel 118 and into the ejection fluid nozzles 116 in the second layer 110 forming the film over the ejection fluid chambers 114. In one example, in such a case, the ejection fluid-impermeable layer of the immiscible fluid can be formed in the intermediate channel 118 or in the ejection fluid nozzle, or both. In said example, the immiscible fluid nozzle may not be provided in the second layer 110. Accordingly, similar to the manner explained above, the provision of the laterally extending intermediate channel 118 can provide a substantially long path for the immiscible fluid as a result of which the immiscible fluid may lose the velocity and is, therefore, not ejected.

In addition, an inner cavity (not shown) of the ejection fluid nozzles 116 can be surface treated, for instance, by plasma treatment, to enhance affinity of the inner cavity towards the immiscible fluid. Such a provision further enhances the drag experienced by the immiscible fluid in the ejection fluid nozzles 116 and prevents the immiscible fluid from being ejected.

Figure 3A:
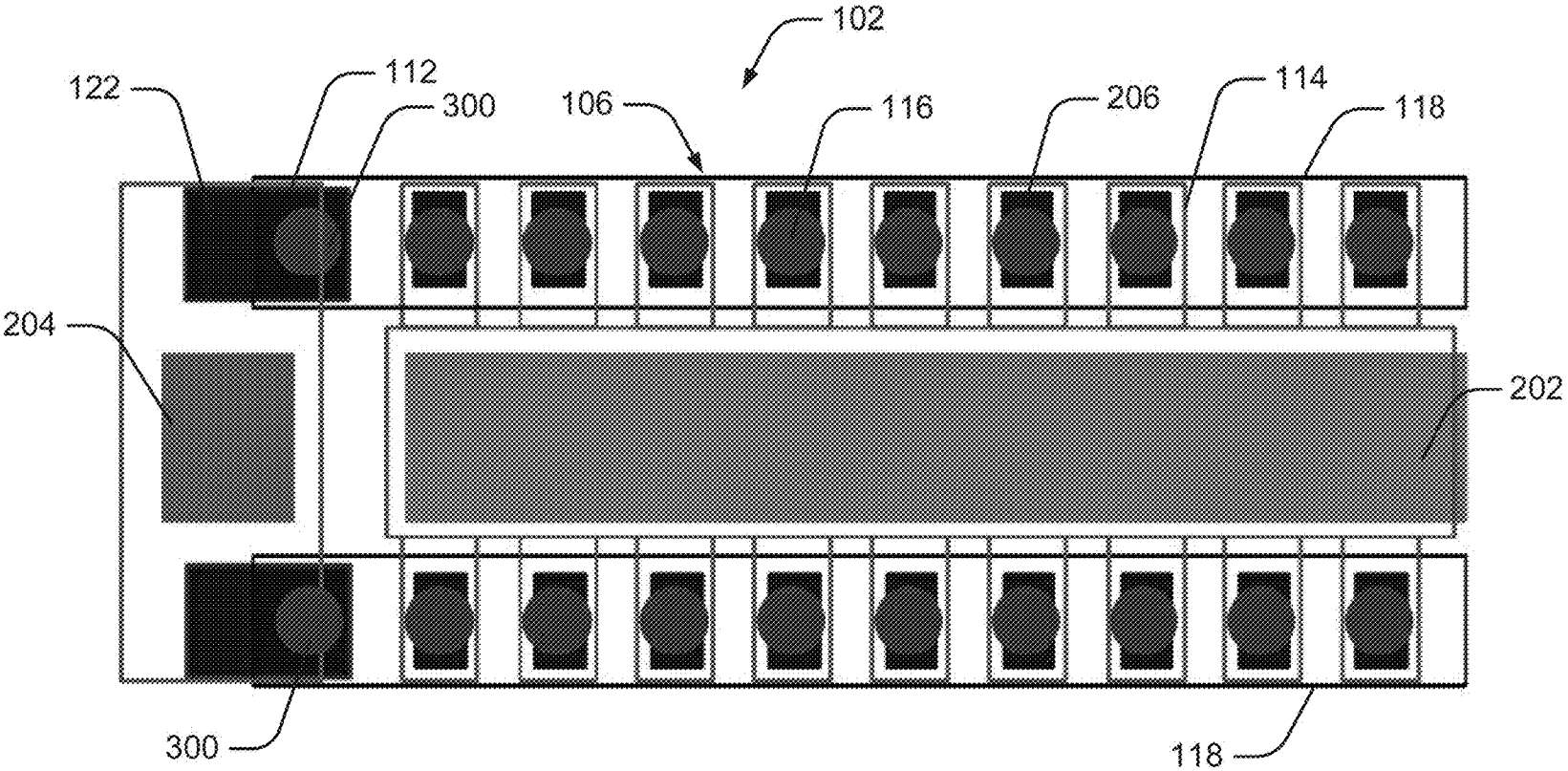
FIGS. 3A and 3B illustrate a nozzle plate of the printhead, according to an example of the present subject matter.
Figure 3B:
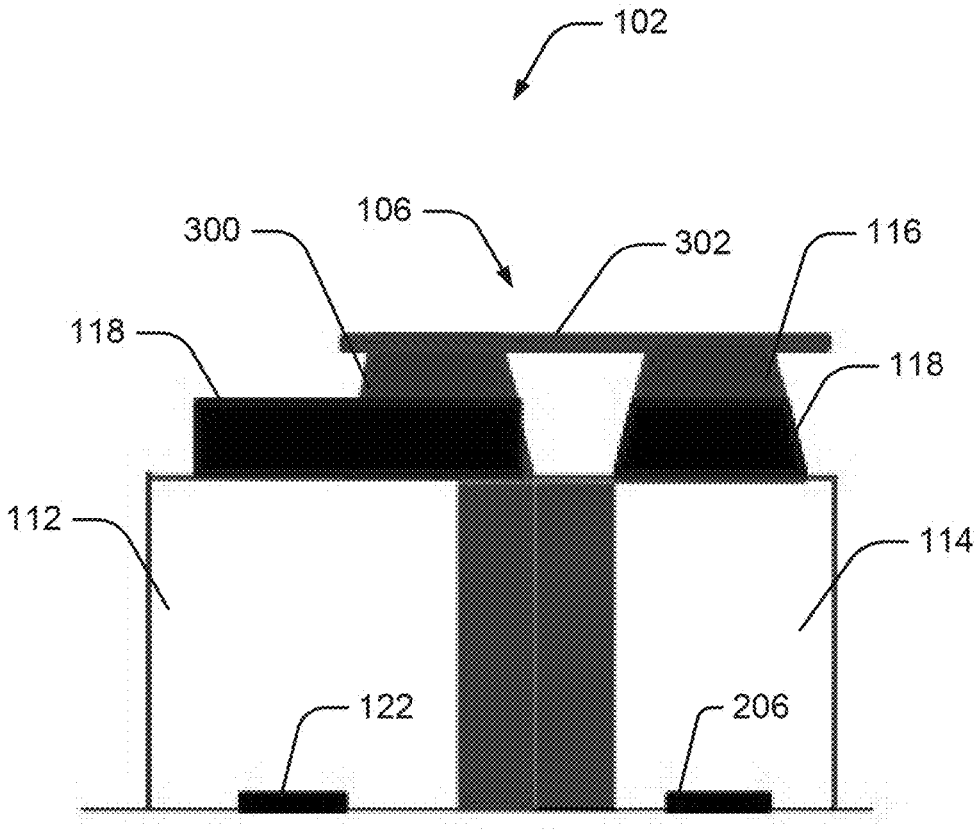

FIG. 3A and FIG. 3B illustrate the nozzle plate 106 of the printhead 102, according to an example of the present subject matter. While FIG. 3A illustrates a front view of the nozzle plate 106, FIG. 3B illustrates a cross sectional view of the nozzle plate 106. As shown, the ejection fluid ejection mechanism 206 provided in line with the ejection fluid nozzles 116, the ejection fluid nozzles 116 being connected to the ejection fluid reservoir 202. In one example, as mentioned before, the ejection fluid reservoir 202 can be formed in the housing 200 of the printhead 102. In an example, as can be seen from FIG. 3B, the intermediate channel 118 is shown as being formed as sandwiched between the first layer 108 and the second layer 110. In addition, at least one immiscible fluid nozzle 300 is in fluid communication with the ejection fluid nozzles 116 through a connecting channel 302 of the ejection fluid nozzles 116.

Accordingly, when the immiscible fluid ejection mechanism 122 is activated by the control device 104, the immiscible fluid flows from the immiscible fluid chamber 112, into the intermediate channel 118, into the immiscible fluid nozzle 300, and then into the connecting channel 302 to form the ejection fluid-impermeable layer in the connecting channel 302 over all the ejection fluid nozzles 116 to form the layer over the ejection fluid in the ejection fluid chambers 114. However, in other examples, the ejection fluid-impermeable layer of the immiscible fluid can be formed in portion of the ejection fluid nozzle 116 between the connecting channel 302 and the intermediate channel, or can be formed in the intermediate channel 118.

Further, according to the present subject matter, the printhead 102 can be provided with other features to provide substantial drag that the immiscible fluid may experience, to prevent the immiscible fluid from being ejected from the immiscible fluid nozzle 300. For instance, the immiscible fluid nozzle 300 in the second layer 110 can be offset from the immiscible fluid ejection mechanism 122, as shown in FIG. 3A and FIG. 3B. As a result of such an offset, the path followed by the immiscible fluid to exit the immiscible fluid nozzle 300 is substantially large and the immiscible fluid experiences substantially large amount of drag and, therefore, is not ejected from the immiscible fluid nozzle 300.

Further, as part of such features for providing substantial drag to the immiscible fluid, in another case, a size of the immiscible fluid nozzle 300 can be substantially greater than a size of the ejection fluid nozzles 116. In such a case too, the greater size of the immiscible fluid nozzle 300 prevents the immiscible fluid from attaining high velocities in the immiscible fluid nozzle 300 and, thereby, prevents the ejection of the immiscible fluid from the immiscible fluid nozzle 300.

Figure 4A:
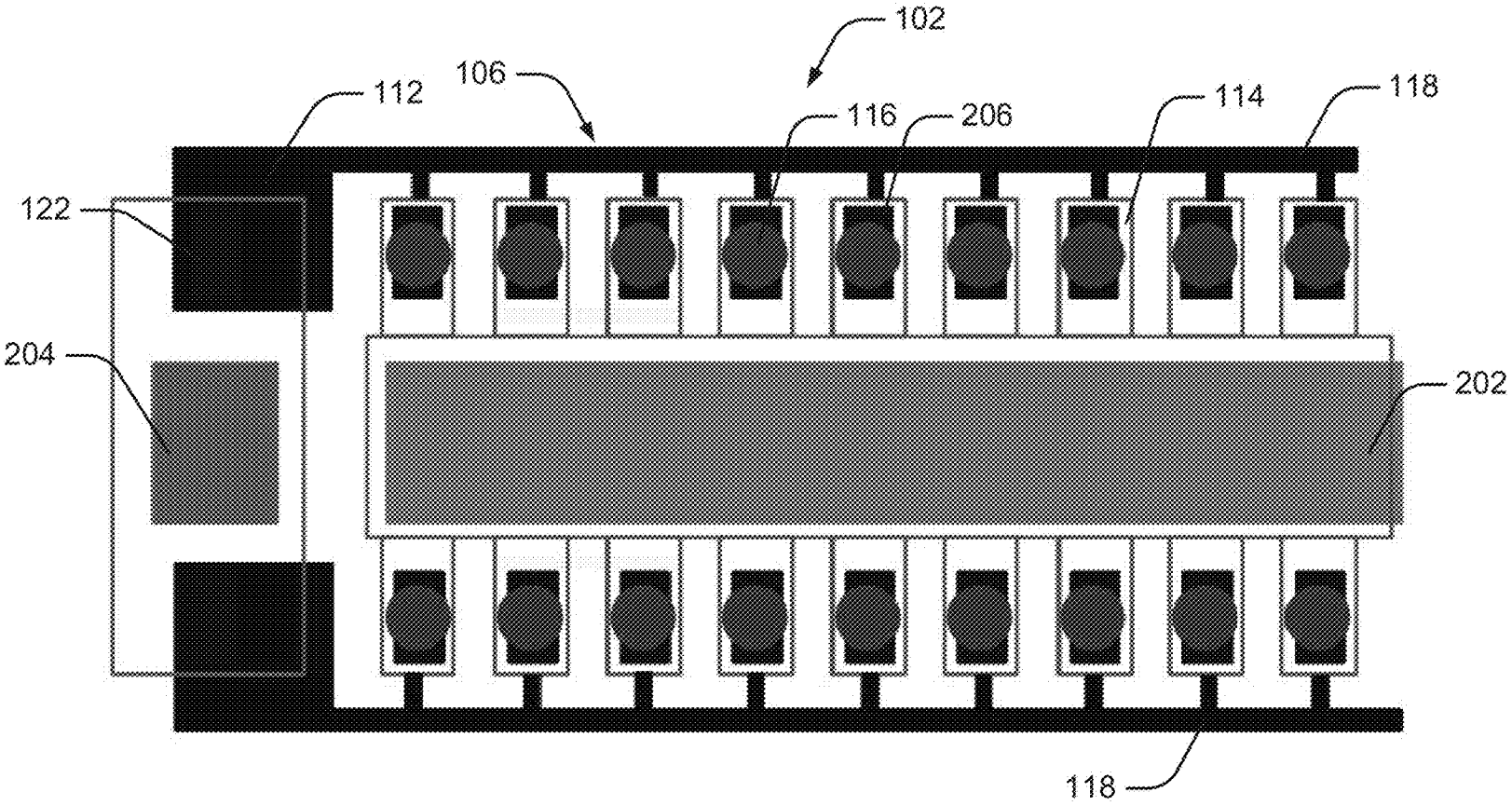
FIGS. 4A and 4B illustrate the nozzle plate, according to another example of the present subject matter.
Figure 4B:
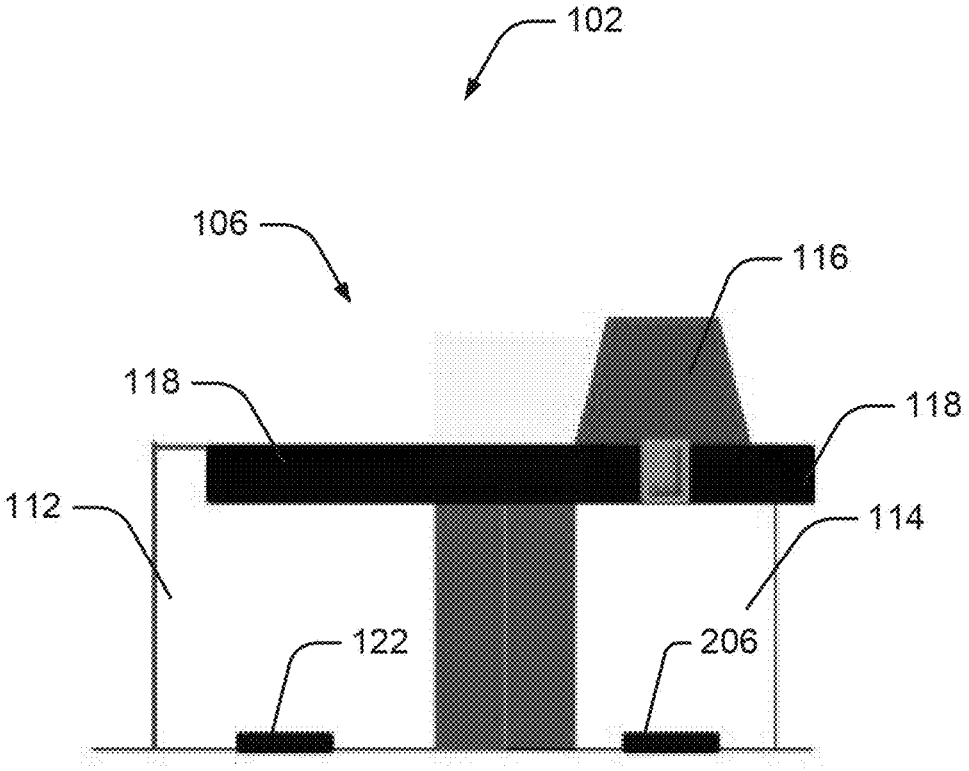

FIG. 4A and FIG. 4B illustrate the nozzle plate 106 of the printhead 102, according to another example of the present subject matter. FIG. 4A illustrates the front view of the nozzle plate 106 and FIG. 4B illustrates a cross sectional view of the nozzle plate 106, in accordance with said example.

As shown, the intermediate channel 118 can be formed laterally with respect to the first layer 108 and the second layer 110. Accordingly, in said example, the intermediate channel 118 can extend sideways from the first layer 108 and the second layer 110 in the nozzle plate 106, as can be seen from FIG. 4A.

In said example, when the immiscible fluid ejection mechanism 122 is activated by the control device 104, the immiscible fluid flows from the immiscible fluid chamber 112, into the intermediate channel 118, and at a base of each of the ejection fluid nozzles 116 to form the ejection fluid-impermeable layer over the ejection fluid in the ejection fluid chambers 114. The base of the ejection fluid nozzles 116 can be understood as the portion of the ejection fluid nozzles 116 in the vicinity of the interface between the first layer 108 and the second layer 110. In other examples, the immiscible fluid can form the ejection fluid-impermeable layer in the ejection fluid nozzles 116, for instance, at an opening of the ejection fluid nozzles 116 opposite to the base. Further, as can be seen, in an example, the second layer 110 is not provided with the immiscible fluid nozzle 300 in such a case.

Figure 5:
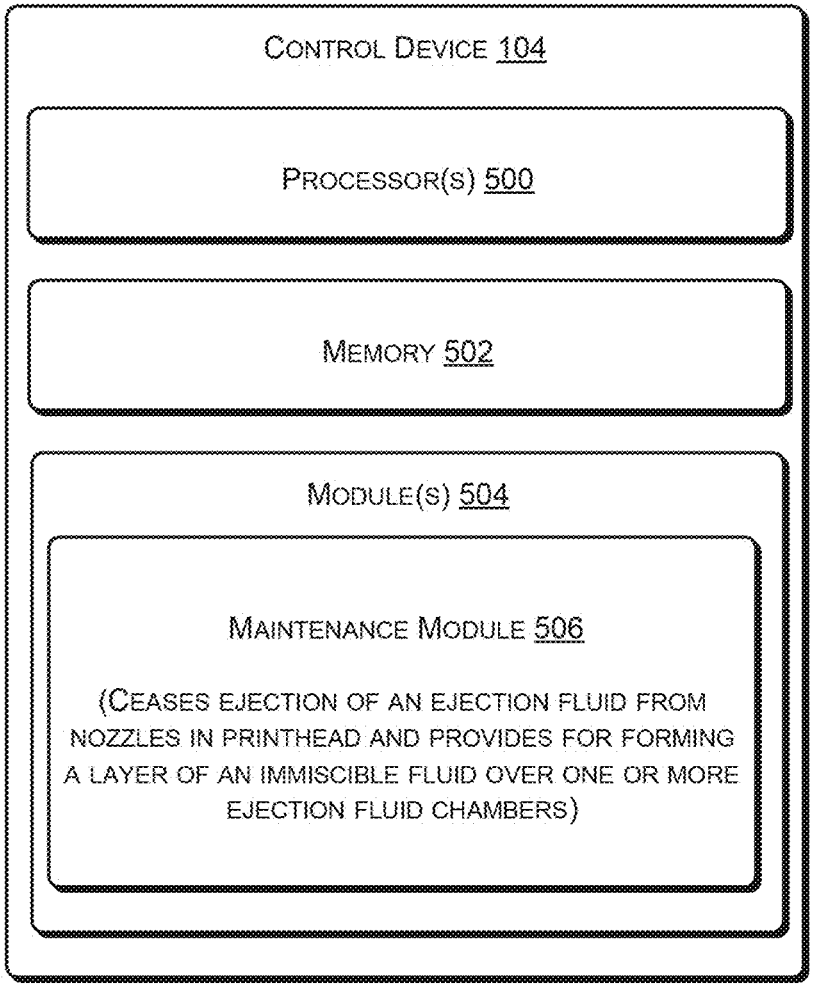
FIG. 5 illustrates a schematic of a control device of the printer, according to an example of the present subject matter.

FIG. 5 illustrates the control device 104 of the printer 100 for regulating the operation of the immiscible fluid ejection mechanism 122 and the ejection fluid ejection mechanism 206, for achieving maintenance of the printhead 102. The control device 104 can include, for example, a processor 500, a memory 502, and modules 504 communicatively coupled to the processor 500. The processor 500, among other capabilities, may fetch and execute computer-readable instructions stored in the memory 502. The memory 502, communicatively coupled to the processor 500, can include a non-transitory computer-readable medium including, for example, volatile memory, such as Static Random Access Memory (SRAM) and Dynamic Random Access Memory (DRAM), and/or low-volatility memory, such as Read Only Memory (ROM), erasable programmable ROM, flash memories, hard disks, optical disks, and magnetic tapes.

The processor 500 may include microprocessors, microcomputers, microcontrollers, digital signal processors, central processing units, state machines, logic circuitries, and/or any other devices that manipulate signals and data based on computer-readable instructions. Further, functions of the various elements shown in the figures, including any functional blocks labeled as "processor(s)", may be provided through the use of dedicated hardware as well as hardware capable of executing computer-readable instructions.

The modules 504, amongst other things, include routines, programs, objects, components, and data structures, which perform particular tasks or deploy particular abstract data types. The modules 504 may also be deployed as, signal processor(s), state machine(s), logic circuitries, and/or any other device or component that manipulates signals based on operational instructions. Further, the modules 504 can be deployed by hardware, by computer-readable instructions executed by a processing unit, or by a combination thereof. The modules 504 can include a maintenance module 506.

During operation, the maintenance module 506 can cease operation of the ejection fluid ejection mechanism 206 to stop ejection of the ejection fluid from the ejection fluid nozzles 116. Further, the maintenance module 506 can regulate the immiscible fluid ejection mechanism 122 to eject the immiscible fluid from the immiscible fluid chamber 112 to each of the ejection fluid nozzles 116 for forming a layer of the immiscible fluid over the ejection fluid chambers 114 in fluid communication with the ejection fluid nozzles 116.

In an example, the maintenance module 506 can regulate the ejection of the immiscible fluid during an idle period of the printhead 102. The idle period of the printhead 102 can be a duration when the ejection of the ejection fluid from the ejection fluid nozzles is to be stopped. For example, in case of the scanning-type printhead, the idle period can be an end of swath, whereas in case of the fixed-type printhead, the idle period can be a predefined non-print period, for instance, corresponding to a portion of the substrate on which printing is not to be done. In another example, the maintenance module 506 can regulate the operation of the immiscible fluid ejection mechanism 122 intermittently after a predetermined time duration. In the above examples, the idle period or the predetermined time duration can be predefined, for instance, by a user of the printer 100.

Although aspects for maintaining the printhead 102 of the printer 100 have been described in language specific to structural features and/or methods, it is to be understood that the appended claims are not necessarily limited to the specific features or methods described. Rather, the specific features and methods are disclosed as examples for maintaining the printhead 102 of the printer 100.

We claim:

1. A printhead of a printer comprising: a nozzle plate comprising, a first layer having at least one immiscible fluid chamber for holding an immiscible fluid, an immiscible fluid ejection mechanism disposed within the at least one immiscible fluid chamber, and a plurality of ejection fluid chambers for holding an ejection fluid, the at least one immiscible fluid chamber being isolated from the plurality of ejection fluid chambers; a second layer haying a plurality of ejection fluid nozzles, wherein one ejection fluid nozzle from the plurality of ejection fluid nozzles is in fluid communication with one ejection fluid chamber from the plurality of ejection fluid chambers; and an intermediate channel forming a passage between the first layer and the second layer to carry the immiscible fluid from the at least one immiscible fluid chamber towards each of the plurality of ejection fluid nozzles, the immiscible fluid ejection mechanism to form, within the intermediate channel, an election fluid-impermeable layer of the immiscible fluid over each of the plurality of ejection fluid chambers to maintain the printhead.

2. The printhead as claimed in claim 1 further comprising a base layer coupled to the first layer, the base layer having an immiscible fluid ejection mechanism, to achieve ejection of the immiscible fluid.

3. The printhead as claimed in claim 2, wherein the immiscible fluid ejection mechanism is formed as integrated circuitry in the base layer.

4. The printhead as claimed in claim 1, wherein the second layer further comprises at least one immiscible fluid nozzle in fluid communication with the at least one immiscible fluid chamber through the intermediate channel, the intermediate channel being sandwiched between the first layer and the second layer.

5. The printhead as claimed in claim 4, wherein the at least one immiscible fluid nozzle is offset from an immiscible fluid ejection mechanism, the immiscible fluid ejection mechanism achieving ejection of the immiscible fluid from the at least one immiscible fluid chamber.

6. The printhead as claimed in claim 4, wherein a size of the at least one immiscible fluid nozzle is greater than a size of the each of the plurality of ejection fluid nozzles.

7. The printhead as claimed in claim 1, wherein the intermediate channel is laterally formed with respect to the first layer and the second layer.

8. The printhead as claimed in claim 1, wherein the intermediate channel is formed of a photosensitive epoxy material.

9. The printhead as claimed in claim 1, wherein an inner cavity of each of the plurality of ejection fluid nozzles is treated to enhance affinity of the inner cavity towards the immiscible fluid.

10. The printhead as claimed in claim 1, wherein the intermediate channel is structured to decrease velocity of the immiscible fluid to prevent ejection of the immiscible fluid from the printhead.

11. The printhead as claimed in claim 1 the at least one immiscible fluid chamber holding a supply of the immiscible fluid, the immiscible fluid being immiscible with the ejection fluid, the ejection fluid chambers holding a supply of the ejection fluid.

12. A printer comprising: a printhead having a nozzle plate, the nozzle plate comprising, a first layer having at least one immiscible fluid chamber for retaining an immiscible fluid and a plurality of ejection fluid chambers for retaining an ejection fluid; a second layer having a plurality of ejection fluid nozzles in fluid communication with the plurality of ejection fluid chambers, an ejection fluid nozzle from the plurality of ejection fluid nozzles provided in fluid communication with an ejection fluid chamber from the plurality of ejection fluid chambers; an intermediate channel forming a passage between the first layer and the second layer, the intermediate channel being in fluid communication with the at least one immiscible fluid chamber; a base layer coupled to the first layer, the base layer having an immiscible fluid ejection mechanism to achieve ejection of the immiscible fluid from the at least one immiscible fluid chamber; and a control device coupled to the immiscible fluid ejection mechanism to regulate the immiscible fluid ejection mechanism to achieve the ejection of the immiscible fluid from the immiscible fluid chamber to convey the immiscible fluid towards at least one ejection fluid nozzle from the plurality of ejection fluid nozzles, the immiscible fluid ejection mechanism to form, within the intermediate channel, an ejection fluid-impermeable film of the immiscible fluid over the ejection fluid chamber in fluid communication with the at least one ejection fluid nozzle.

13. The printer as claimed in claim 12, wherein the control device is to regulate the immiscible fluid ejection mechanism to achieve the ejection of the immiscible fluid during an idle period of the printhead, the idle period of the printhead being a duration when the ejection of the ejection fluid from the plurality of ejection fluid nozzles is stopped.

14. The printer as claimed in claim 12, wherein the control device is to regulate the immiscible fluid ejection mechanism to achieve the ejection of the immiscible fluid intermittently after a predetermined time duration.

15. The printer as claimed in claim 12, wherein the second layer further comprises at least one immiscible fluid nozzle in fluid communication with the at least one fluid chamber through the intermediate channel, the intermediate channel being formed sandwiched between the first layer and the second layer.

16. The printer as claimed in claim 12, wherein the intermediate channel is laterally formed with respect to the first layer and the second layer.

17. The printer as claimed in claim 12, the control device to form the film of the immiscible fluid over the ejection fluid chamber to prevent drying of the ejection fluid.

18. The printer as claimed in claim 17, the control device to direct the immiscible fluid to form the film of the immiscible fluid at the fluid ejection nozzles.

19. The printer as claimed in claim 17, the control device to direct the immiscible fluid to form the film of the immiscible fluid in the intermediate channel.

20. A control device for regulating maintenance of a printhead of a printer, the control device comprising: a processor, a nontransitory computer readable-medium having computer executable instructions stored thereon, executable by the processor, and a maintenance module coupled to the processor, wherein the maintenance module ceases operation of an ejection fluid ejection mechanism to stop ejection of an ejection fluid from a plurality of ejection fluid nozzles in the printhead, each of a plurality of ejection fluid nozzles being in fluid communication with an ejection fluid chamber; an intermediate channel forming a passage between the at least one immiscible fluid chamber and each of the plurality of ejection fluid nozzles, and the maintenance modules to regulate an immiscible fluid ejection mechanism to eject an immiscible fluid from at least one fluid chamber in the printhead towards each of the plurality of ejection fluid nozzles to form, within the intermediate channel, an ejection fluid-impermeable layer of the immiscible fluid over the ejection fluid retained in the ejection fluid chamber.

* * * * *